United States Patent [19]

Stark

[11] 4,381,877

[45] May 3, 1983

[54] HINGE MECHANISM FOR DOOR OF A COIN OPERATED LOCKER CABINET

[75] Inventor: Forest G. Stark, Jamestown, N.Y.

[73] Assignee: American Locker Security Systems, Inc., Jamestown, N.Y.

[21] Appl. No.: 204,594

[22] Filed: Nov. 6, 1980

[51] Int. Cl.[3] ..... E05D 7/12

[52] U.S. Cl. ..... 312/138 R; 312/217; 312/220; 312/319; 16/380

[58] Field of Search ..... 312/319, 217, 220; 16/380; 292/143; 49/453

[56] References Cited

U.S. PATENT DOCUMENTS

| | | | |
|---|---|---|---|
| 1,133,627 | 3/1915 | Farnsworth | 312/217 |
| 2,644,555 | 7/1953 | Saaf | 16/380 |
| 2,719,322 | 10/1955 | Hager et al. | 16/380 |
| 2,808,610 | 10/1957 | Minor | 312/138 R |
| 3,193,074 | 7/1965 | Stackhouse | 292/143 |
| 3,398,426 | 8/1968 | McGahee | 16/380 |
| 3,497,906 | 3/1970 | McFadden | 16/380 |
| 3,778,932 | 12/1973 | Ewing | 49/388 |
| 3,834,612 | 9/1974 | Bixby | 232/25 |
| 3,977,044 | 8/1976 | Mort | 16/380 |
| 4,190,929 | 3/1980 | Palka | 16/169 |

FOREIGN PATENT DOCUMENTS

| | | | |
|---|---|---|---|
| 1169493 | 12/1958 | France | 16/380 |
| 204399 | 9/1923 | United Kingdom . | |
| 216438 | 5/1924 | United Kingdom . | |
| 602596 | 5/1948 | United Kingdom . | |
| 1203099 | 8/1970 | United Kingdom . | |
| 1348857 | 3/1974 | United Kingdom . | |
| 1442240 | 7/1976 | United Kingdom . | |
| 2033465 | 5/1980 | United Kingdom . | |
| 2049798 | 12/1980 | United Kingdom . | |

*Primary Examiner*—Victor N. Sakran

*Attorney, Agent, or Firm*—Bean, Kauffman & Bean

[57] ABSTRACT

A cabinet construction is disclosed featuring the utilization of spring-biased hinge pins for removably mounting one or more doors for swinging movement between cabinet storage compartment closed and open positions in combination with a security device for normally preventing access to such hinge pins for door removal purposes. The invention additionally features a novel door/hinge assembly.

10 Claims, 5 Drawing Figures

HINGE MECHANISM FOR DOOR OF A COIN OPERATED LOCKER CABINET

BACKGROUND OF THE INVENTION

The present invention relates broadly to the utilization of spring biased hinge pins to facilitate mounting of one or more doors on a cabinet and more particularly to an improved construction having particular utility for use in a coin operated locker or cabinet, wherein it is desired to prevent unauthorized removal of doors by manipulation of their hinge mechanism.

Heretofore, it has been proposed to provide a door or other closure with a hinge mounting assembly incorporating spring biased hinge pins. For instance, U.S. Pat. No. 3,778,932 discloses a hinge mounting assembly of this type, wherein a handle is fixed to each hinge pin to permit manual retractions thereof for door mounting-/removal purposes.

A cabinet door having removable hinge pins normally hidden from view by such door is disclosed by U.S. Pat. No. 4,190,929.

It has also been proposed in U.S. Pat. No. 3,834,612 to provide a locked cabinet door with concealed hinge pins to which access may be gained for door removal purposes. In accordance with a first form of the invention disclosed by this patent, doors can not be removed by a custodian for replacement purposes, regardless of whether they are in open or closed condition, without first dismantling a frame portion of the cabinet carrying all of the doors. In a second form of such invention, door supporting hinge bars are adapted to be removably fixed to the cabinet by means of common screws whose heads are made accessible upon movement of their associated doors into open position. Each form of the invention described in U.S. Pat. No. 3,834,612 possesses certain disadvantages for use in both general cabinet and coin operated locker cabinet constructions. Thus, a drawback of the first form is the requirement that the cabinet be formed with a separate frame or grid for carrying all of the doors; a separate, exposed hinge for mounting the separate frame on the cabinet to afford access to the individual door hinges; and a separate lock for retaining the frame in a closed or use position. A drawback of the second form is that the screws mounting the respective doors are easily seen and rendered accessible for unauthorized door removal purposes, whenever any door is in an open/unlocked condition.

SUMMARY OF THE INVENTION

The present invention is directed toward an improved cabinet construction featuring the utilization of spring biased hinge pins for removably mounting one or more cabinet doors in combination with a hidden security device for normally preventing access to such hinge pins for door removal purposes.

Another aspect of the present invention is a novel door/hinge assembly, which may be inexpensively and easily fabricated and greatly facilitates assembly/repair of a cabinet.

In accordance with one form of the present invention, a cabinet includes at least one storage compartment having an access opening vertically bounded by a pair of horizontally extending cabinet frame members, one of said frame members having the interior thereof accessible from within the storage compartment; a door for closing the access opening; hinge means for mounting the door on the frame members for movement between access opening closed and open positions, such hinge means including upper and lower hinge means each comprising an aperture formed in one of the door and the frame members and a hinge pin carried by the other thereof and removably received within its associated aperture, characterized in that the one frame member is formed with one of the apertures and its associated hinge pin is spring biased to removably position an inserted end thereof within the interior of the one frame member; and means removably fixed within the interior of the one frame member for normally preventing unauthorized removal of the associated hinge pin from within the aperture of the one frame member against the spring bias.

In accordance with a preferred form of the invention, a cabinet includes a cabinet frame including horizontally extending upper, lower and at least one intermediate frame member cooperating to vertically bound access openings of at least two storage compartments, characterized in that one of the upper and lower frame members is provided with an aperture, that the other of the upper and lower frame members mounts a hinge pin, that the intermediate frame member has a through opening arranged in vertical alignment with the aperture of the one frame member and the hinge pin and that the one frame member has its interior accessible through an adjacent storage compartment whose access opening it bounds; a plurality of releasably lockable doors associated one with each of the access openings, each of the doors having means defining a pair of vertically aligned first and second bearing openings disposed on each door relatively adjacent the one and the other of said frame members, respectively, the first bearing openings slidably mounting hinge pins to alternately project through the through opening of an adjacent intermediate frame member for receipt within the second bearing opening of a next adjacent door or through the aperture of the one frame member for receipt within the interior thereof, the first of the bearing openings having associated therewith, stop means projecting thereinto and a spring arranged for end bearing engagement with the stop means and the hinge pin slidably received therein, the second bearing opening having stop means positioned therewithin for end engagement by a hinge pin slidably supported by the first bearing opening of a vertically adjacent door with the second bearing opening of the door immediately adjacent the other frame member receiving the hinge pin carried thereby; and security means disposed within the interior of the one frame member and accessible through its adjacent storage compartment for normally preventing manually induced removal from within its aperture of the inserted end of the hinge pin slidably received within the first bearing opening of an adjacent door.

DRAWINGS

The nature and mode of operation of the present invention will now be more fully described in the following detailed description taken with the accompanying drawings wherein.

DETAILED DESCRIPTION

Figure 1:
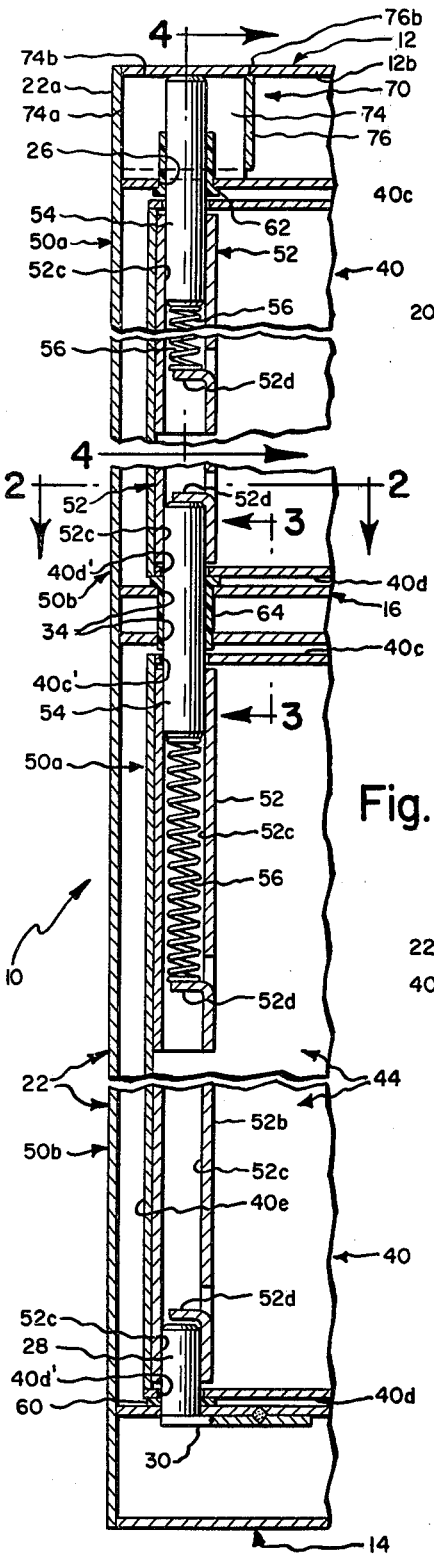
FIG. 1 is a vertical sectional view illustrating a plurality of doors hingedly mounted on horizontal extending frame members of a cabinet, which vertically bound access openings to cabinet storage compartments.
Figure 4:
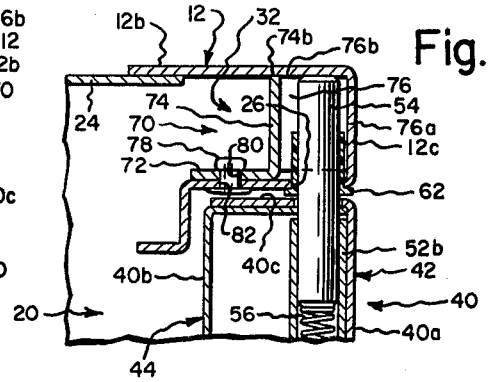
FIG. 4 is a sectional view taken generally along line 4—4 in FIG. 1.
Figure 3:
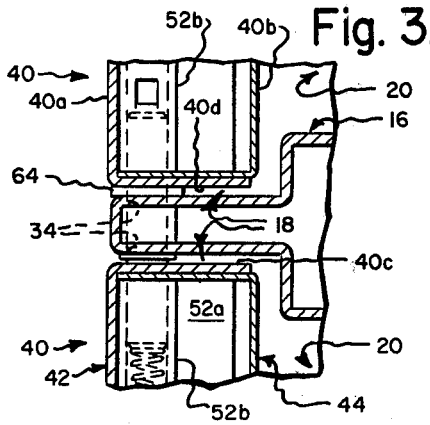
FIG. 3 is a sectional view taken generally along line 3—3 in FIG. 1.
Figure 2:
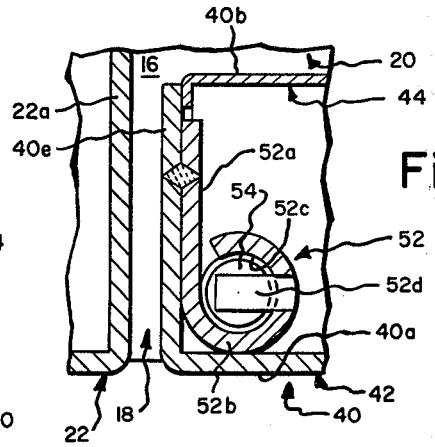
FIG. 2 is a sectional view taken generally along line 2—2 in FIG. 1.

Reference is first made to FIG. 1, wherein a cabinet incorporating the present invention is generally designated as 10, and shown in part as having a cabinet frame including upper, lower and at least one intermediate horizontally extending frame member 12, 14 and 16, respectively, which cooperate to vertically bound access openings, designated as 18 in FIGS. 2 and 3, leading to at least two vertically aligned storage compartments, designated as 20 in FIGS. 2–4. Frame members 12, 14 and 16 have their opposite ends suitably fixed to a pair of upstanding side frame members, only one of which is shown and designated as 22 in FIGS. 1 and 2. Panels, only one of which is shown and designated as 24 in FIG. 4, are suitably affixed to frame members 12, 14, 16 and 22, as well as other frame members comprising remaining portions of the cabinet frame, not shown, to define top, side and rear outer surfaces of cabinet 10, as well as top, bottom, side and rear surfaces of compartments 20, as required. The number of storage compartments employed in any given cabinet construction is a matter of choice.

In accordance with the present invention, one of upper and lower frame members, and preferably upper frame member 12, would be formed with an aperture 26, shown in FIGS. 1 and 4, while the other thereof would be fitted with an upstanding hinge pin 28, shown in FIG. 1 as being fixed thereto as by spot welding its mounting plate 30 to frame member 14. As best shown in FIG. 4, upper frame member 12 is constructed and arranged such that its interior 32 is rendered accessible from within its vertically adjacent compartment 20. By referring to FIGS. 1 and 3, it will be understood that each intermediate frame member 16 is formed with a through opening 34 disposed in vertical alignment with aperture 26 and pin 28.

Cabinet 10 is also provided with a plurality of doors 40, which are associated one with each compartment 20 and hingedly supported by means to be described on frame members 12, 14 and 16 for horizontally directed swinging movements between access opening closed and open positions. As will become apparent, the present invention possesses particular utility for use in cabinets of the type commonly known as coin operated lockers and employed to provide temporary security for personal belongings upon payment of a fee. For this type of cabinet, a suitable lock, such as for instance a coin operated lock of the type disclosed in U.S. Pat. No. 3,193,074, would be mounted on the cabinet frame for the purpose of releasably locking each of doors 40 in an access open closed position illustrated in the drawings.

Preferably, doors 40 are of a hollow construction and defined by a pair of generally pan shaped front and rear door panels 42 and 44, which have their marginal flange portions suitably joined, as by spot welding, to define door front and rear surface portions 40*a* and 40*b*, respectively; and top, bottom and side edge portions 40*c*, 40*d*, and 40*e*, respectively. As best shown in FIG. 1, top and bottom edge portions 40*c* and 40*d* are formed with aligned openings 40*c*' and 40*d*', respectively, to permit mounting of doors 40 in the manner to now be described.

Each of doors 40 is hingedly supported by upper and lower hinge means 50*a* and 50*b*, which preferably include a pair of identically fabricated curl plates 52 and 52 having mounting flange portions 52*a* and 52*a* and curls 52*b* and 52*b*, which define bearing openings 52*c* and 52*c*. Plates are accurately positionally fixed within their associated door 40 for the purpose of arranging bearing openings 52*c* and 52*c* in axial alignment with each other and openings 40*c*' and 40*d*', as by spot welding, to retain flange portions 52*a* and 52*a* and curls 52*b* and 52*b* in engagement with the inner surfaces of edge and front portions 40*a* and 40*e*, respectively, as best shown in FIG. 2. Further, by referring to FIG. 1, it will be seen that the curl of each curl plate 52 is provided with a stop 52*d* arranged to project into its bearing opening 52*c* at a point spaced inwardly of a lower end thereof. Stop 52*d* may be suitably defined, as by a punch forming operation. Upper hinge means 50*a* is shown in FIG. 1 as additionally including a cylindrical hinge pin 54, which is slidably and rotatably supported within the bearing opening 52*c* of its associated curl plate 52, and a coil type compression spring 56 arranged with its ends in bearing engagement with the lower end of hinge pin 54 and the upwardly facing surface of an associated stop 52*d*.

To facilitate vertical placement and smooth swinging movements of doors 40, cabinet 10 is also provided with a bearing ring 60 arranged to encircle hinge pin 28 intermediate frame member 14 and lower edge portion 40*d* of the lowermost of doors 40; an upper bearing sleeve 62 friction fit within aperture 26 of upper frame member 12; and an intermediate bearing sleeve 64 fit within through opening 34 of intermediate frame member 16. Preferably, bearing ring 60 and sleeves 62 and 64 are formed from a plastic material, such as Nylon or Teflon, which permits at least a limited degree of resilient deformation thereof.

Figure 5:
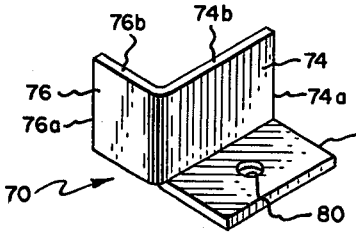
FIG. 5 is a perspective view of a security device shown in section in FIGS. 1 and 4.

By now referring specifically to FIGS. 1, 4 and 5, it will be seen that the present construction additionally includes a security device 70, which is preferably in the form of a metal plate shaped to define a mounting flange portion 72 and an upstanding security flange portion having parts 74 and 76. Security device 70 is intended to be rigidly fixed within interior 32 of upper frame member 12 by a rivet 78 received within an aperture 80 formed in a lower flange portion 12*a* of frame member 12 and an aperture 82 formed in mounting flange portion 72. When the security device is fixed in position, side and upper edges 74*a* and 74*b* of security flange part 74 are disposed in close proximity to or in surface engagement with an inner flange portion 22*a* of side frame member 22 and an upper flange 12*b* of frame member 12, respectively; and the side and upper edges 76*a* and 76*b* of security flange part 76 are disposed in close proximity to or in surface engagement with a front flange portion 12*c* and an upper flange portion 12*b* of frame member 12, respectively.

In accordance with the present invention, doors 40 may be mounted on frame members 12, 14 and 16 by means of the following procedure with bearing ring 60 and bearing sleeves 62 and 64 being pre-installed, as desired. As a first step, a spring 56 would normally be inserted into the uppermost of the bore openings 52*c* of the lowermost one of the doors to be installed, and such door then fitted into the access opening 18 of the lowermost compartment 20 to position hinge pin 28 within the lowermost of its bore openings 52*c* and arrange the uppermost of its bore openings in axial alignment with sleeve insert 64. Insertion of hinge pin 28 is permitted, due to the illustrated construction coupled with a loose sliding fit provided for hinge pin 28 within its associated bore opening and/or due to flexure of adjacent parts, as for instance mounting plate 30 and/or frame member 14. It is not necessary that hinge pin 28 engage its associated stop 52*d*, rather such hinge pin need only be of sufficient length to provide for a proper bearing support for the lowermost door, and in the case of the illustrated construction, would preferably be as short as possible to facilitate its insertion within the lowermost bore opening. Alternately, a curl or the like could be fitted within lower frame member 14 for the purpose of slidably supporting hinge pin 28 and a suitable spring employed to normally bias such hinge pin upwardly into engagement with stop 52*d*; the hinge pin being forced into a fully retracted position against such bias to facilitate mounting of the door.

After fitting of the lowermost door 40, a hinge pin 54 may be inserted downwardly through bearing sleeve 64 for receipt within the uppermost bearing opening 52*c* of the lowermost door for engagement with the previously inserted spring 56.

If the cabinet is to be fitted with more than two vertically aligned doors, the next step in the assembly operation would be to fit the next vertically adjacent or a first intermediate door within the next vertically adjacent or a first intermediate access opening of the cabinet by repeating steps of the procedure discussed with reference to the lowermost door. During insertion of the next door, hinge pin 54 would be manually depressed against the bias of its associated spring 56 until the next door is properly fitted with its lowermost bore opening 52*c* aligned with the hinge pin, whereupon the spring is permitted to bias the hinge pin upwardly within such lowermost bore opening into engagement with its associated stop 52*d*. Thereafter, the spring and stop cooperate to constrain vertical movements of the hinge pin and retain same in the position illustrated in FIG. 1, wherein its mid-portion is supported by bearing sleeve 64 and its ends extend relatively equi-distant into the ends of adjacent bore openings of the lowermost and next adjacent doors. In any case, the last to be installed or uppermost door would normally be installed by repeating the procedure discussed above, with the exception that its hinge pin 54 would be fitted within its associated uppermost bore opening 52*c* and depressed against the bias of its associated spring 56 prior to fitting of such door. After the uppermost door is properly fitted, its associated spring 56 is operable to bias its associated hinge pin 54 upwardly through bearing sleeve 62 for end engagement with upper flange portion 12*b*, which serves as a stop cooperating with the spring to positionally locate the hinge pin with its mid-portion within bearing sleeve 62.

Either prior or subsequent to installation of doors 40, security device 70 may be manually inserted inwardly and upwardly through the uppermost compartment 20 for positioning within the interior 32 of upper frame member 12, as previously described with reference to FIGS. 1 and 4. When security device 70 is properly positioned with apertures 80 and 82 disposed in vertical alignment, a suitable rivet gun or the like may be employed to fix rivet 78 within the aligned apertures in order to positively and permanently fix the security device in position.

If after cabinet 10 is placed in service, one of doors 40 should be damaged and require replacement, the damaged door can be removed and replaced by the following procedure. A custodian or other authorized workman would first operate the uppermost of the cabinet doors in order to gain access to rivet 78, which would then be removed, as by drilling, in order to release and permit temporary removal of security device 70 from within upper frame member 12. The custodian would then use the tips of his fingers or a suitable tool, not shown, to depress the exposed upper or inserted end of hinge pin 54 sufficiently to clear the bottom end of upper bearing sleeve 62 and permit the uppermost door to be tilted outwardly and then lifted from engagement with the next lower hinge pin 54. As will be apparent from viewing FIGS. 3 and 4, the placement of the axes of hinge pins 54 and bearing sleeves 62 and 64 closely adjacent the front of the door and frame members 12 and 16; the vertical clearances between the door and frame members; the resiliency of the bearing sleeves; and the clearance between the next lower hinge pin and its associated bore openings required to permit free sliding/rotational movements thereof, permits the door to tilt outwardly as required for disassembly purposes without incurring destructive deformation of the door and/or its hinges or excessive binding of the next lower hinge pin within the lowermost bore opening of such door. Doors would be successively removed in this manner until the damaged door is reached and it too removed. A replacement door and the remaining undamaged/previously removed doors, if any, would then be installed following the original door assembly procedure described above. After all of the doors are installed, the custodian would again manually insert security device 70 within upper frame member 12 and drive a new or replacement rivet into realigned apertures 80 and 82.

It will be understood that the present invention has utility in diverse cabinet constructions, whether of single or multiple door construction, in that it provides for an inexpensive and readily fabricated door/hinge construction, as well as greatly facilitating assembly/repair of a cabinet. However, as mentioned above, the invention possesses particular utility in coin operated lockers or otherwise operated security cabinets, wherein the integrity of a cabinet and the security of its contents are prime considerations. In this connection, the present construction possesses the additional advantage of having a completely hidden hinge mechanism, whose hinge pins are not subject to view and tampering. Moreover, the ability of a locker custodian to replace damaged doors, as opposed to the present commercial practice of requiring the return of a whole locker unit to a factory for door repair purposes, possesses substantial practical and financial advantages. Exposure of rivet 78 for tampering purposes, when the uppermost storage compartment of a conventional locker unit is not in use and its door thus assuming an unlocked condition, is not considered to present a serious security problem, since rivet 78 may be made to appear similar to other rivets employed in the fabrication of the cabinet and thus would normally go unnoticed. Increased security may, however, be achieved by fabricating rivet 78 from material requiring a special drill bit and/or by forming the interior of upper frame member 12 in a manner requiring the use of a special tool to depress the uppermost hinge pin after access thereto has been afforded by removal of security device 70. In any event, noise generated by an unauthorized drilling operation would likely be noticed by the custodian having charge of the locker cabinet.

Having described in detail a preferred embodiment of the present invention, it will be understood that details of the construction may be altered without departing from the spirit of the invention, as defined by the following claims.

I claim:

1. A cabinet comprising in combination:

at least one storage compartment having an access opening vertically bounded by a pair of horizontally extending cabinet frame members, one of said frame members having the interior thereof accessible only from within said storage compartment;

a door for closing said access opening;

hinge means for mounting said door on said frame members for movement between access opening closed and open positions, said hinge means including upper and lower hinge means each comprising an aperture formed in one of said door and said frame members and a hinge pin carried by the other thereof and removably received within its associated aperture, characterized in that said one frame member is formed with one of said apertures and its associated hinge pin is received therewithin to removably position an inserted end thereof within said interior of said one frame member, is supported for axial sliding movements by said door and has associated therewith spring means for normally maintaining said inserted end within said interior of said one frame member; and means removably inserted within said interior of said one frame member from within said storage compartment only when said door is in open position for normally preventing unauthorized removal of said associated hinge pin from within said one of said apertures against the bias of said spring means.

2. A cabinet according to claim 1, wherein said cabinet includes an upstanding side frame member extending vertically between said horizontally extending frame members, the last said means cooperates with said one frame member and said side frame member to constrain unauthorized removal of said inserted end from within said one of said apertures.

3. A cabinet according to claim 1, wherein said last said means is normally fixed to said one frame member by means of a rivet, and said rivet is accessible through said access opening only when said door is in said open position.

4. A cabinet according to claim 3, wherein said cabinet includes an upstanding side frame member extending vertically between said horizontally extending frame members, said last said means is a metal plate having a mounting flange portion fixed to said one frame member by said rivet and a security flange portion cooperating with interior surface of said one frame member and said side frame member to fully enclose said inserted end of said hinge pin.

5. A cabinet according to claim 1, wherein said upper and lower hinge means includes a pair of identical curl plates fixed within the interior of said door and defining vertically aligned bore openings disposed in turn in alignment with openings formed in upper and lower edge portions of said door, each of said curl plates defining a stop projecting into its respective bore opening, one of said bore openings slidably supporting said associated hinge pin with said spring means being disposed therewithin for end abutting engagement with an end of said associated hinge pin opposite to said inserted end and said stop associated with said one of said bore openings, and the other of said bore openings defines the other of said apertures, said cabinet includes at least one additional horizontally extending frame member cooperating with the other of said frame members to vertically bound at least one additional access opening of at least one additional storage compartment, each said additional frame member having a vertically extending through opening, each said additional access opening is closed by an additional door having additional upper and lower hinge means, characterized in that the one of said additional hinge means positioned vertically adjacent each said additional frame member includes a spring biased hinge pin removably extending successively through said through opening and into the other of said bore openings of a vertically adjacent door for end bearing engagement with said stop associated therewith.

6. A cabinet according to claim 5, wherein said cabinet additionally includes an upstanding side frame member extending vertically between said pair of horizontally extending frame members, the last said means is normally fixed to said one frame member by means of a rivet accessible through said access opening only when said door is in said open position, and said last said means is a metal plate having a mounting flange portion fixed to said one frame member by said rivet and a security flange portion cooperating with interior surfaces of said one frame member and said side frame member to fully enclose said inserted end.

7. A coin operated locker cabinet or the like comprising in combination:

a cabinet frame including horizontally extending upper, lower and at least one intermediate frame member cooperating to vertically bound access openings of at least two vertically aligned storage compartments, one of said upper and lower frame members is provided with an aperture, the other of said upper and lower frame members carries a hinge pin, each said intermediate frame member having a through opening arranged in vertical alignment with said aperture and said hinge pin, and the one of said upper and lower frame members provided with said aperture having the interior thereof accessible through an adjacent storage compartment whose access opening it bounds;

a plurality of releasably lockable doors associated one with each of said access openings of said storage compartments, each of said doors having means defining a pair of vertically aligned first and second bearing openings disposed on each door relatively adjacent said one and said other of said frame members, respectively, said first bearing openings slidably mounting hinge pins to alternately project through said through opening of an adjacent intermediate frame member for receipt within the second bearing opening of a next adjacent door or through said aperture for receipt within the interior of said one of said frame members, said first of said bearing openings having associated therewith stop means projecting thereinto and a spring arranged for end bearing engagement with said stop means and said hinge pin slidably received therewithin, said second bearing openings having stop means positioned therewithin for end engagement by a hinge pin slidably supported by the first bearing opening of a vertically adjacent door with the second bearing opening of the door immediately adjacent said other of said frame members receiving said hinge pin carried thereby; and means disposed within said interior of said one of said frame members for normally preventing manually induced movement from within said aperture of an inserted end of the hinge pin slidably received within said first of said bearing openings of an adjacent door, and the last said means is accessible through the storage compartment adjacent to said one of said frame members for permitting said movement only when the door associated with its access opening is in an open position.

8. A cabinet according to claim 7, wherein said cabinet additionally includes an upstanding side frame member extending between said upper and lower frame members, the last said means is removably inserted into said interior of said one of said frame members from within its adjacent storage compartment and normally fixed by means of a rivet to said one of said frame members, said rivet being accessible only when the door associated with said adjacent storage compartment is in open position and said last said means is a metal plate having a mounting flange portion fixed to said one of said frame members by said rivet and a security flange portion cooperating with interior surfaces of said one of said frame members and said side frame member to fully enclose said inserted end.

9. A cabinet according to claim 7, wherein each of said doors is of a hollow construction having front and rear portions, upper and lower edge portions and side edge portions, said upper and lower edge portions having aligned openings therethrough, each of said doors enclosing a pair of curl plates each having a mounting portion and a curl portion, the curl portions of said curl plates defining said first and second bearing openings with the latter being maintained in vertical alignment with each other and said openings of said upper and lower edge portions by means fixing the mounting portions and the curl portions of each pair of curl plates in abutting engagement with inner surfaces of said front and one of said side edge portions of their associated door, respectively.

10. A cabinet according to claim 9, wherein said cabinet additionally includes an upstanding side frame member extending between said upper and lower frame members, said one of said frame members is said upper frame member, the last said means is removably inserted within said interior of said upper frame member from within its adjacent storage compartment and normally fixed by means of a rivet to said upper frame member, said rivet being accessible only when the door associated with said adjacent storage compartment is in open position, and said last said means is a metal plate having a mounting flange portion fixed to said upper frame member by said rivet and a security flange portion cooperating with interior surfaces of said upper frame member and said side frame member to fully enclose said inserted end.

* * * * *